US010672332B2

(12) United States Patent
Lee et al.

(10) Patent No.: US 10,672,332 B2
(45) Date of Patent: Jun. 2, 2020

(54) PIXEL COMPENSATION CIRCUIT AND DRIVING METHOD THEREOF, AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Sangwon Lee, Beijing (CN); Min Ho Ko, Beijing (CN); Sang Hun Kang, Beijing (CN); Young Yik Ko, Beijing (CN); Wanli Dong, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 30 days.

(21) Appl. No.: 15/981,199

(22) Filed: May 16, 2018

(65) Prior Publication Data

US 2019/0114960 A1 Apr. 18, 2019

(30) Foreign Application Priority Data

Oct. 18, 2017 (CN) ..... 2017 1 0969954

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0819* (2013.01);
(Continued)

(58) Field of Classification Search
CPC ..... G09G 3/3233; G09G 2300/0852; G09G 2320/045
See application file for complete search history.

(56) References Cited

U.S. PATENT DOCUMENTS 7,173,590 B2 * 2/2007 Uchino ..... G09G 3/30 345/92
7,378,739 B2 * 5/2008 Kwak ..... G09G 3/3233 257/207
(Continued)

FOREIGN PATENT DOCUMENTS

CN 1577453 A 2/2005
CN 1684558 A 10/2005
(Continued)

OTHER PUBLICATIONS

The First Chinese Office Action dated Mar. 4, 2019, Appln. No. 201710969954.7.

*Primary Examiner* — William Boddie
*Assistant Examiner* — Bipin Gyawali

(57) ABSTRACT

A pixel compensation circuit and a driving method thereof, and a display device. The pixel compensation circuit includes: a driving sub-circuit; a light-emitting device; an initialization sub-circuit, configured to initialize a control electrode of the driving sub-circuit; a data writing sub-circuit, configured to provide a data signal to the control electrode of the driving sub-circuit; a voltage input sub-circuit, configured to provide a signal of the first power supply terminal to the first electrode of the driving sub-circuit; a storage and voltage division sub-circuit, configured to store a voltage of the first electrode of the driving sub-circuit, and when the control electrode of the driving sub-circuit is floating, maintain stability of a voltage difference between the control electrode and the first electrode of the driving sub-circuit; and a threshold compensation sub-
(Continued)

circuit, configured to write a threshold voltage of the driving sub-circuit into the first electrode of the driving sub-circuit.

20 Claims, 4 Drawing Sheets

(52) U.S. Cl.
CPC ..... *G09G 2300/0852* (2013.01); *G09G 2300/0861* (2013.01); *G09G 2310/0251* (2013.01); *G09G 2310/0262* (2013.01); *G09G 2320/0204* (2013.01); *G09G 2320/0233* (2013.01); *G09G 2320/043* (2013.01); *G09G 2320/045* (2013.01)

(56) References Cited

U.S. PATENT DOCUMENTS 7,688,292 B2 * 3/2010 Park ..... G09G 3/3233 345/82
7,936,407 B2 * 5/2011 Kim ..... G02F 1/136213 349/129
8,159,420 B2 * 4/2012 Takahashi ..... G09G 3/3233 345/76
8,237,631 B2 * 8/2012 Tanikame ..... G09G 3/3233 345/76
9,013,375 B2 * 4/2015 Yoo ..... G09G 3/3233 345/76
9,224,335 B2 * 12/2015 Yoon ..... G09G 3/3233
9,773,449 B2 * 9/2017 Lin ..... G09G 3/3233
9,773,451 B2 * 9/2017 Wu ..... G09G 3/3258
10,043,794 B2 * 8/2018 Kimura ..... H01L 27/0629
10,056,035 B2 * 8/2018 Liu ..... G09G 3/3241
10,067,588 B2 * 9/2018 Tan ..... G06F 3/0416
10,262,615 B2 * 4/2019 Hu ..... G11C 19/184
2004/0207614 A1 * 10/2004 Yamashita ..... G09G 3/2014 345/211
2005/0017934 A1 1/2005 Chung et al.
2005/0243036 A1 11/2005 Ikeda
2005/0285825 A1 12/2005 Eom et al.
2007/0024541 A1 * 2/2007 Ryu ..... G09G 3/3233 345/76
2007/0273620 A1 * 11/2007 Yumoto ..... G09G 3/32 345/76
2008/0158114 A1 * 7/2008 Kim ..... G09G 3/3233 345/77
2009/0295772 A1 12/2009 Kim et al.
2011/0176078 A1 * 7/2011 Kim ..... G02F 1/136213 349/38
2011/0221791 A1 * 9/2011 Kajiyama ..... G09G 3/3233 345/690
2011/0227885 A1 * 9/2011 Chung ..... G09G 3/3241 345/204
2011/0285691 A1 * 11/2011 Takasugi ..... G09G 3/3233 345/212
2012/0105408 A1 5/2012 Kang
2014/0176520 A1 * 6/2014 Hwang ..... G09G 3/003 345/211
2014/0333680 A1 * 11/2014 Choi ..... G09G 3/3233 345/690
2014/0368487 A1 12/2014 Chang et al.
2015/0145853 A1 * 5/2015 Zeng ..... G09G 3/3233 345/215
2016/0351122 A1 * 12/2016 Jung ..... G09G 3/2085
2018/0005575 A1 * 1/2018 Lee ..... G09G 3/3233
2018/0033365 A1 * 2/2018 Zhang ..... G09G 3/3233
2018/0204510 A1 * 7/2018 Chung ..... H01L 51/5206
2019/0096323 A1 * 3/2019 Lee ..... G09G 3/3233
2019/0172396 A1 * 6/2019 Yang ..... G09G 3/3258

FOREIGN PATENT DOCUMENTS

CN 101593767 A 12/2009
CN 202838917 U 3/2013
CN 103489397 A 1/2014
CN 104318894 A 1/2015
CN 205622743 U 11/2016
CN 106205486 A 12/2016
KR 1020120064975 A 6/2012

* cited by examiner

PIXEL COMPENSATION CIRCUIT AND DRIVING METHOD THEREOF, AND DISPLAY DEVICE

The present application claims the priority of the Chinese Patent Application No. 201710969954.7 filed on Oct. 18, 2017, which is incorporated herein by reference in its entirety as part of the disclosure of the present application.

TECHNICAL FIELD

Embodiments of the present disclosure relate to a pixel compensation circuit and a driving method thereof, and a display device.

BACKGROUND

An Organic Light-Emitting Diode (OLED) display is one of hot topics in a current display research field. As compared with a Liquid Crystal Display (LCD), the OLED display has advantages of low energy consumption, low production cost, self-luminescence, a wide viewing angle, a fast response speed, and the like. Currently, in display fields such as mobile phones, tablet computers, and digital cameras, OLED displays have begun to replace traditional LCD displays.

Unlike an LCD display, which controls brightness with stable voltages, the OLED display is current-driven and needs a steady current to control its light emission. Due to manufacture processes, device aging, and so on, threshold voltages Vth of driving transistors that drive the OLED display to emit light may be uneven, resulting in a change in a current flowing through each OLED to cause uneven display brightness, and then a display effect of an entire image is affected. Moreover, since the current flowing through each OLED is related to a power supply voltage connected with a source electrode of the driving transistor, IR drop may also cause current difference in different regions, which further causes uneven brightness of the OLED display in different regions.

SUMMARY

Embodiments of the disclosure provide a pixel compensation circuit, comprising: an initialization sub-circuit, a data writing sub-circuit, a threshold compensation sub-circuit, a voltage input sub-circuit, a storage and voltage division sub-circuit, a driving sub-circuit and a light-emitting device; wherein:

the initialization sub-circuit is respectively connected with a reset signal terminal, a first power supply terminal and a control electrode of the driving sub-circuit, and is configured to provide a signal of the first power supply terminal to the control electrode of the driving sub-circuit under control of the reset signal terminal;

the data writing sub-circuit is respectively connected with a scan signal terminal, a data signal terminal and the control electrode of the driving sub-circuit, and is configured to provide a data signal of the data signal terminal to the control electrode of the driving sub-circuit under control of the scan signal terminal;

the voltage input sub-circuit is respectively connected with a light-emission control signal terminal, the first power supply terminal and a first electrode of the driving sub-circuit, and is configured to provide the signal of the first power supply terminal to the first electrode of the driving sub-circuit under control of the light-emission control signal terminal;

the storage and voltage division sub-circuit is respectively connected with the control electrode of the driving sub-circuit, the first electrode of the driving sub-circuit and a reference voltage signal terminal, and is configured to: store a voltage of the first electrode of the driving sub-circuit; when the first electrode of the driving sub-circuit is floating, couple a voltage of the control electrode of the driving sub-circuit to the first electrode of the driving sub-circuit, and divide a voltage of the first electrode of the driving sub-circuit; and when the control electrode of the driving sub-circuit is floating, maintain stability of a voltage difference between the control electrode and the first electrode of the driving sub-circuit;

the threshold compensation sub-circuit is respectively connected with a compensation control signal terminal, the reference voltage signal terminal, the control electrode of the driving sub-circuit, a second electrode of the driving sub-circuit and a first terminal of the light-emitting device, and is configured to turn on the driving sub-circuit to write a threshold voltage of the driving sub-circuit into the first electrode of the driving sub-circuit under control of the compensation control signal terminal; and the first terminal of the light-emitting device is connected with the second electrode of the driving sub-circuit, and a second terminal of the light-emitting device is connected with a second power supply terminal.

For example, the driving sub-circuit includes a driving transistor.

For example, the threshold compensation sub-circuit includes: a first switching transistor and a second switching transistor;

a control electrode of the first switching transistor is connected with the compensation control signal terminal, a first electrode of the first switching transistor is connected with the reference voltage signal terminal, and a second electrode of the first switching transistor is connected with a control electrode of the driving transistor; and a control electrode of the second switching transistor is connected with the compensation control signal terminal, a first electrode of the second switching transistor is connected with the reference voltage signal terminal, and a second electrode of the second switching transistor is connected with a second electrode of the driving transistor.

For example, the initialization sub-circuit includes: a third switching transistor; and a control electrode of the third switching transistor is connected with the reset signal terminal, a first electrode of the third switching transistor is connected with the first power supply terminal, and a second electrode of the third switching transistor is connected with a control electrode of the driving transistor.

For example, the storage and voltage division sub-circuit includes: a storage capacitor and a voltage division capacitor;

a first terminal of the storage capacitor is connected with a control electrode of the driving transistor, and a second terminal of the storage capacitor is connected with a first electrode of the driving transistor; and a first terminal of the voltage division capacitor is connected with the first electrode of the driving transistor, and a second terminal of the voltage division capacitor is connected with the reference voltage signal terminal.

For example, a capacitance value of the storage capacitor is smaller than a capacitance value of the voltage division capacitor.

For example, the capacitance value of the storage capacitor is c1, the capacitance value of the voltage division capacitor is c2, and $$0.75 \leqslant \frac{c_1}{c_2} < 1.$$

For example, the voltage input sub-circuit includes: a fourth switching transistor; and a control electrode of the fourth switching transistor is connected with the light-emission control signal terminal, a first electrode of the fourth switching transistor is connected with the first power supply terminal, and a second electrode of the fourth switching transistor is connected with a first electrode of the driving transistor.

For example, the data writing sub-circuit includes: a fifth switching transistor; and a control electrode of the fifth switching transistor is connected with the scan signal terminal, a first electrode of the fifth switching transistor is connected with the data signal terminal, and a second electrode of the fifth switching transistor is connected with a control electrode of the driving transistor.

For example, the driving transistor is a P-type transistor.

For example, both the first switching transistor and the second switching transistor are P-type transistors.

For example, the third switching transistor is a P-type transistor.

For example, the fourth switching transistor is a P-type transistor.

For example, the fifth switching transistor is a P-type transistor.

For example, the light-emitting device is an OLED light-emitting device.

Embodiments of the disclosure provide a display device, comprising the pixel compensation circuit described above.

Embodiments of the disclosure further provide a driving method of the pixel compensation circuit described above, comprising:

in an initialization phase, under control of a reset signal terminal, providing a signal of a first power supply terminal to a control electrode of a driving sub-circuit by an initialization sub-circuit; under control of a light-emission control signal terminal, providing the signal of the first power supply terminal to a first electrode of the driving sub-circuit via a voltage input sub-circuit; and storing a voltage of the first electrode of the driving sub-circuit by a storage and voltage division sub-circuit;

in a threshold compensation phase, under control of a compensation control signal terminal, turning on the driving sub-circuit by a threshold compensation sub-circuit to write a threshold voltage of the driving sub-circuit into the first electrode of the driving sub-circuit; and storing the voltage of the first electrode of the driving sub-circuit by the storage and voltage division sub-circuit;

in a data writing phase, under control of a scan signal terminal, providing a data signal of a data signal terminal to the control electrode of the driving sub-circuit by the data writing sub-circuit; coupling a signal of the control electrode of the driving sub-circuit to the first electrode of the driving sub-circuit by the storage and voltage division sub-circuit, and dividing the voltage of the first electrode of the driving sub-circuit; and in a light emission phase, under control of a light-emission control signal terminal, providing the signal of the first power supply terminal to the first electrode of the driving sub-circuit by the voltage input sub-circuit; maintaining stability of a voltage difference between the control electrode and the first electrode of the driving sub-circuit by the storage and voltage division sub-circuit; and under combined control of the control electrode and the first electrode of the driving sub-circuit, generating a driving current by the driving sub-circuit to drive a light-emitting device to emit light.

For example, the driving sub-circuit includes a driving transistor.

For example, the storage and voltage division sub-circuit includes: a storage capacitor and a voltage division capacitor, and a capacitance value of the storage capacitor is smaller than a capacitance value of the voltage division capacitor.

For example, the capacitance value of the storage capacitor is c1, the capacitance value of the voltage division capacitor is c2, and $$0.75 \leqslant \frac{c_1}{c_2} < 1.$$

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

DETAILED DESCRIPTION

Figure 1:
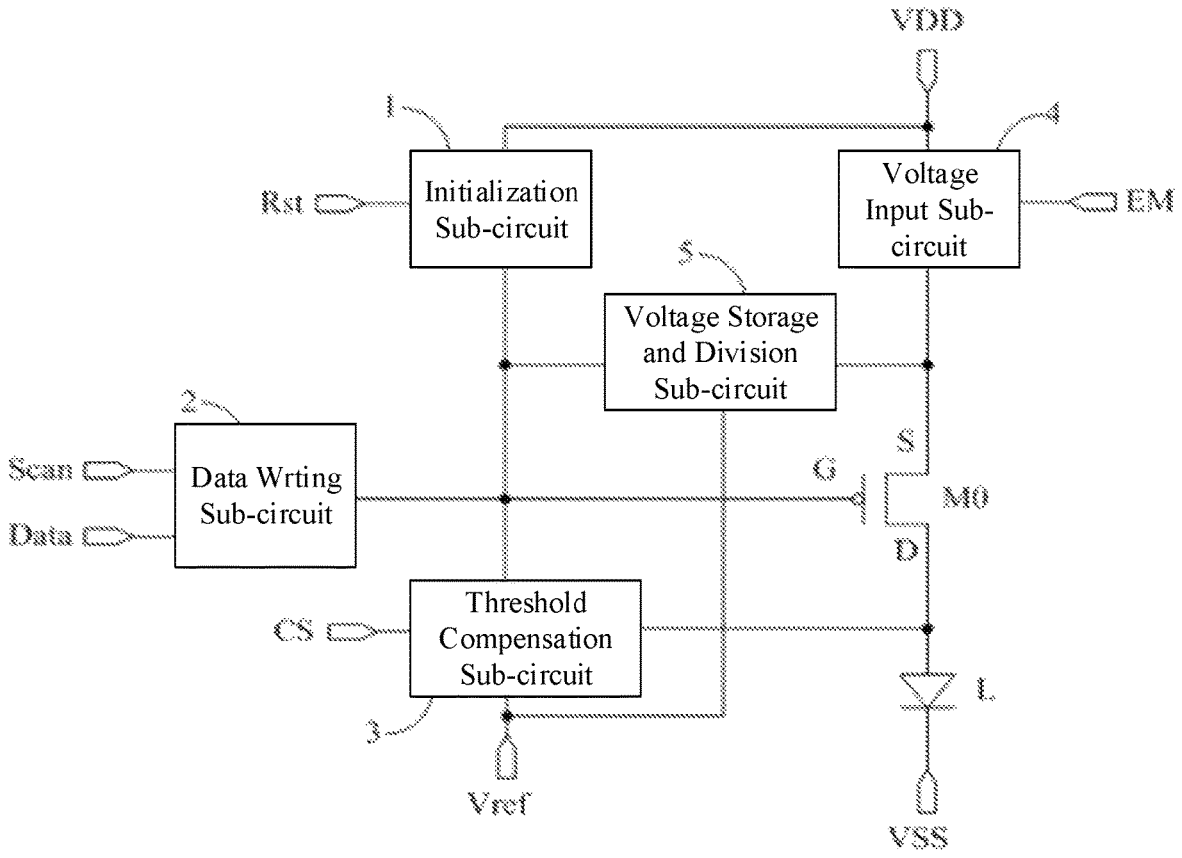
FIG. 1 is a structural schematic diagram of a pixel compensation circuit provided by an embodiment of the present disclosure.

In order to make objects, technical details and advantages of the present disclosure apparent, specific implementing modes of a pixel compensation circuit, a driving method thereof, and a display device provided by embodiments of the present disclosure will be described in detail below in conjunction with the accompanying drawings. It should be understood that the preferred embodiments described below are merely used for illustrating and explaining the present disclosure, and are not used for limiting the present disclosure. And in a case of no conflict, the embodiments in the present application and features in the embodiments may be combined with each other.

In order to avoid influence of threshold voltages Vth of driving transistors on brightness of an OLED display, the OLED display generally drives the OLEDs to emit light with pixel compensation circuits that can compensate for the threshold voltages Vth. However, in order to implement functions of initialization and writing a data voltage, the pixel compensation circuit generally inputs an initialization signal and a data signal transmitted from a data line into the pixel compensation circuit, with a switching transistor connected with the data line, which results in that a source driving circuit inputting signals to the data line needs to switch between the initialization signal and the data signal, so as to output a corresponding signal. Since power consumption occurs when the signals changes, the power consumption of the source driving circuit increases, which is not conducive to reducing the power consumption of the OLED display.

Embodiments of the present disclosure provide a pixel compensation circuit and a driving method thereof, and a display device, so as to maintain stability of a working current for driving a light-emitting device to emit light, and improve evenness of image display brightness.

The embodiments of the present disclosure provide a pixel compensation circuit and a driving method thereof, and a display device. The pixel compensation circuit comprises: an initialization sub-circuit, a data writing sub-circuit, a threshold compensation sub-circuit, a voltage input sub-circuit, a storage and voltage division sub-circuit, a driving sub-circuit and a light-emitting device. The initialization sub-circuit is configured to provide a signal of a first power supply terminal to a control electrode of the driving sub-circuit under control of a reset signal terminal. The data writing sub-circuit is configured to provide a signal of a data signal terminal to the control electrode of the driving sub-circuit under control of a scan signal terminal. The voltage input sub-circuit is configured to provide a signal of the first power supply terminal to a first electrode of the driving sub-circuit under control of a light-emission control signal terminal. The storage and voltage division sub-circuit is configured to: store a voltage of the first electrode of the driving sub-circuit; when the first electrode of the driving sub-circuit is floating, couple the voltage of the control electrode of the driving sub-circuit to the first electrode of the driving sub-circuit, and divide the voltage of the first electrode of the driving sub-circuit; and when the control electrode of the driving sub-circuit is floating, maintain stability of a voltage difference between the control electrode and the first electrode of the driving sub-circuit. The threshold compensation sub-circuit is configured to turn on the driving sub-circuit under control of a compensation control signal terminal, to write a threshold voltage of the driving sub-circuit into the first electrode of the driving sub-circuit. Therefore, by mutual cooperation of the above-described respective sub-circuits, a driving current of the driving sub-circuit for driving the light-emitting device to emit light can be made to be irrelevant to the threshold voltage of the driving sub-circuit and the voltage of the first power supply terminal, so as to avoid influence of the threshold voltage of the driving sub-circuit and IR drop on the driving current flowing through the light-emitting device, so that stability of the driving current is maintained, and further evenness of image brightness of a display region in the display device is improved. In addition, since the data signal terminal is used merely for inputting a data signal, when the above-described pixel compensation circuit is applied in the display device, the source driving circuit may output only the data signal through the data line, which may reduce power consumption as compared with a source driving circuit that outputs different signals. Further, power consumption of the OLED display device is reduced.

An embodiment of the present disclosure provides a pixel compensation circuit, as shown in FIG. 1, comprising: an initialization sub-circuit 1, a data writing sub-circuit 2, a threshold compensation sub-circuit 3, a voltage input sub-circuit 4, a storage and voltage division sub-circuit 5, a driving sub-circuit (for example, including a driving transistor M0) and a light-emitting device L.

The initialization sub-circuit 1 is respectively connected with a reset signal terminal Rst, a first power supply terminal VDD and a control electrode G of the driving transistor M0, and is configured to provide a signal of the first power supply terminal VDD to the control electrode G of the driving transistor M0 under control of the reset signal terminal Rst.

The data writing sub-circuit 2 is respectively connected with a scan signal terminal Scan, a data signal terminal Data and the control electrode G of the driving transistor M0, and is configured to provide a signal of the data signal terminal Data to the control electrode G of the driving transistor M0 under control of the scan signal terminal Scan.

The voltage input sub-circuit 4 is respectively connected with a light-emission control signal terminal EM, the first power supply terminal VDD and a first electrode S of the driving transistor M0, and is configured to provide a signal of the first power supply terminal VDD to the first electrode S of the driving transistor M0 under control of the light-emission control signal terminal EM.

The storage and voltage division sub-circuit 5 is respectively connected with the control electrode G of the driving transistor M0, the first electrode S of the driving transistor M0, and a reference voltage signal terminal Vref, and is configured to: store a voltage of the first electrode S of the driving transistor M0; when the first electrode of the driving transistor M0 is floating, couple a voltage of the control electrode G of the driving transistor M0 to the first electrode S of the driving transistor M0, and divide the voltage of the first electrode S of the driving transistor M0; and when the control electrode G of the driving transistor M0 is floating, maintain stability of a voltage difference between the control electrode G and the first electrode S of the driving transistor M0.

The threshold compensation sub-circuit 3 is respectively connected with a compensation control signal terminal CS, the reference voltage signal terminal Vref, the control electrode G of the driving transistor M0, a second electrode D of the driving transistor M0, and a first terminal of the light-emitting device L, and is configured to turn on the driving transistor M0 to write a threshold voltage of the driving transistor M0 into the first electrode S of the driving transistor M0 under control of the compensation control signal terminal CS.

The first terminal of the light-emitting device L is connected with the second electrode D of the driving transistor M0, and a second terminal of the light-emitting device L is connected with a second power supply terminal VSS.

The pixel compensation circuit provided by embodiments of the present disclosure comprises: the initialization sub-circuit, the data writing sub-circuit, the threshold compensation sub-circuit, the voltage input sub-circuit, the storage and voltage division sub-circuit, the driving sub-circuit (e.g., a driving transistor) and the light-emitting device. The initialization sub-circuit is configured to provide the signal of the first power supply terminal to the control electrode of the driving transistor under the control of the reset signal terminal. The data Writing sub-circuit is configured to provide the signal of the data signal terminal to the control electrode of the driving transistor under the control of the scan signal terminal. The voltage input sub-circuit is configured to provide the signal of the first power supply terminal to the first electrode of the driving transistor under the control of the light-emission control signal terminal. The storage and voltage division sub-circuit is configured to store the voltage of the first electrode of the driving transistor; when the first electrode of the driving transistor is floating, couple the voltage of the control electrode of the driving transistor to the first electrode of the driving transistor, and divide the voltage of the first electrode of the driving transistor; and when the control electrode of the driving transistor is floating, maintain stability of the voltage difference between the control electrode and the first electrode of the driving transistor. The threshold compensation sub-circuit is configured to turn on the driving transistor under the control of the compensation control signal terminal, to write the threshold voltage of the driving transistor into the first electrode of the driving transistor. The above-described pixel compensation circuit provided by embodiments of the present disclosure, by mutual cooperation of the above-described sub-circuits and the driving transistor, may make the driving current of the driving transistor for driving the light-emitting device to emit light to be irrelevant to the threshold voltage of the driving transistor and the voltage of the first power supply terminal, and may avoid influence of the threshold voltage of the driving transistor and IR drop on the driving current flowing through the light-emitting device, so as to maintain stability of the driving current, and to improve evenness of image brightness of the display region in the display device. In addition, in the above-described pixel compensation circuit provided by embodiments of the present disclosure, since the data signal terminal is used merely for inputting the data signal, when the above-described pixel compensation circuit is applied to the display device, the source driving circuit may output only the data signal through the data line, which may reduce power consumption as compared with a source driving circuit that outputs different signals. Further, power consumption of the OLED display device is reduced.

For example, in the above-described pixel compensation circuit provided by embodiments of the present disclosure, as shown in FIG. 1, the driving transistor M0 may be a P-type transistor; where the control electrode G of the driving transistor M0 is a gate electrode of the driving transistor M0, the first electrode S of the driving transistor M0 is a source electrode of the driving transistor M0, the second electrode D of the driving transistor M0 is a drain electrode of the driving transistor M0, and when the driving transistor M0 is in a saturated state, a current flows from the source electrode of the driving transistor M0 to the drain electrode of the driving transistor M0.

For example, in the above-described pixel compensation circuit provided by embodiments of the present disclosure, a first terminal of the light-emitting device is a positive electrode of the light-emitting device, and a second terminal is a negative electrode of the light-emitting device. In addition, the light-emitting device is generally an organic light-emitting diode that implements light emission under an action of the driving current when the driving transistor is in the saturated State. Besides, generally, the light-emitting device has a light-emitting threshold voltage, and emits light when the voltage across the two terminals of the light-emitting device is greater than or equal to the light-emitting threshold voltage.

For example, in the above-described pixel compensation circuit provided by embodiments of the present disclosure, the voltage Vdd of the first power supply terminal is generally a positive value, and the voltage Vref of the reference voltage signal terminal is generally a negative value. The voltage Vss of the second power supply terminal is generally a ground voltage or has a negative value. In actual applications, the above-described respective voltages can be designed and determined according to an actual application environment, which will not be limited here.

Hereinafter, the present disclosure will be described in details below in conjunction with specific embodiments. It should be noted that, these embodiments are intended to better explain the present disclosure, but does not limit the present disclosure.

Figure 2:
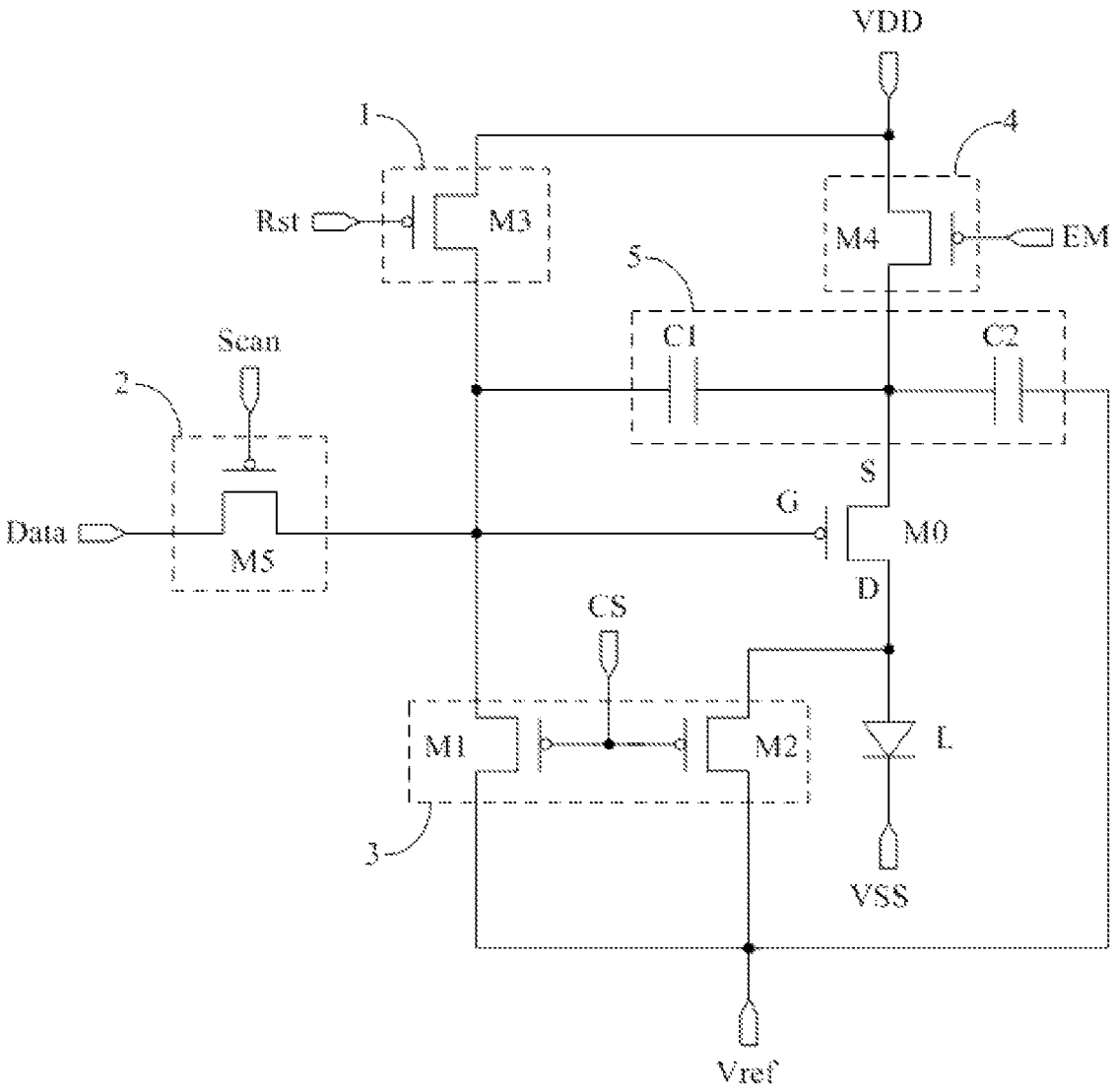
FIG. 2 is a circuit schematic diagram of a pixel compensation circuit provided by an embodiment of the present disclosure.

For example, in the above-described pixel compensation circuit provided by embodiments of the present disclosure, as shown in FIG. 2, the data writing sub-circuit 2 may include: a fifth switching transistor M5, where a control electrode of the fifth switching transistor M5 is connected with the scan signal terminal Scan, a first electrode of the fifth switching transistor M5 is connected with the data signal terminal Data, and a second electrode of the fifth switching transistor M5 is connected with the control electrode G of the driving transistor M0.

For example, in the above-described pixel compensation circuit provided by embodiments of the present disclosure, as shown in FIG. 2, the fifth switching transistor M5 may be a P-type transistor. Alternatively, the fifth switching transistor may also be an N-type transistor, which will not be limited here.

For example, in the above-described pixel compensation circuit provided by embodiments of the present disclosure, when the fifth switching transistor is in a turning-on state under the control of the scan signal terminal, the fifth switching transistor may provide the data signal of the data signal terminal to the control electrode of the driving transistor, so as to write the data signal into the control electrode of the driving transistor.

For example, in the above-described pixel compensation circuit provided by embodiments of the present disclosure, as shown in FIG. 2, the initialization sub-circuit 1 may include: a third switching transistor M3, where a control electrode of the third switching transistor M3 is connected with the reset signal terminal Rst, a first electrode of the third switching transistor M3 is connected with the first power supply terminal VDD, and a second electrode of the third switching transistor M3 is connected with the control electrode G of the driving transistor M0.

For example, in the above-described pixel compensation circuit provided by embodiments of the present disclosure, as shown in FIG. 2, the third switching transistor M3 may be a P-type transistor. Alternatively, the third switching transistor may also be an N-type transistor, which will not be limited here.

For example, in the above-described pixel compensation circuit provided by embodiments of the present disclosure, when the third switching transistor is in a turning-on state under the control of the reset signal terminal, the third switching transistor may provide the signal of the first power supply terminal to the control electrode of the driving transistor, so as to initialize the control electrode of the driving transistor.

For example, in the above-described pixel compensation circuit provided by embodiments of the present disclosure, as shown in FIG. 2, the storage and voltage division sub-circuit 4 may include: a storage capacitor C1 and a voltage division capacitor C2.

A first terminal of the storage capacitor C1 is connected with the control electrode G of the driving transistor M0, and a second terminal of the storage capacitor C1 is connected with the first electrode S of the driving transistor M0.

A first terminal of the voltage division capacitor C2 is connected with the first electrode S of the driving transistor M0, and a second terminal of the voltage division capacitor C2 is connected with the reference voltage signal terminal Vref.

For example, in the above-described pixel compensation circuit provided by embodiments of the present disclosure, the storage capacitor may charge or discharge according to the voltage of the first electrode of the driving transistor and the voltage of the control electrode of the driving transistor, so as to store the voltage of the first electrode of the driving transistor. When the control electrode of the driving transistor is in a floating state, due to a bootstrap effect the storage capacitor may maintain the voltage difference between the control electrode and the first electrode of the driving transistor to be stable. When the first electrode of the driving transistor is in a floating state, due to a coupling effect the storage capacitor may couple the signal of the control electrode of the driving transistor to the first electrode of the driving transistor. The voltage division capacitor may also charge or discharge according to the voltage of the first electrode of the driving transistor and the voltage of the reference voltage signal terminal, so as to store the voltage of the first electrode of the driving transistor. In addition, the voltage division capacitor may divide the voltage which is coupled to the first electrode of the driving transistor by the storage capacitor.

For example, in the above-described pixel compensation circuit provided by embodiments of the present disclosure, a capacitance value c2 of the voltage division capacitor is greater than a capacitance value c1 of the storage capacitor. Specifically, c1 and c2 may satisfy the following relationship:

$$0.75 \leqslant \frac{c_1}{c_2} < 1.$$

Of course, in actual applications, c1 and c2 can be designed and determined according to an actual application environment, which will not be limited here.

For example, in the above-described pixel compensation circuit provided by embodiments of the present disclosure, as shown in FIG. 2, the voltage input sub-circuit 4 may include: a fourth switching transistor M4, wherein a control electrode of the fourth switching transistor M4 is connected with the light-emission control signal terminal EM, a first electrode of the fourth switching transistor M4 is connected with the first power supply terminal VDD, and a second electrode of the fourth switching transistor M4 is connected with the first electrode S of the driving transistor M0.

For example, in the above-described pixel compensation circuit provided by embodiments of the present disclosure, as shown in FIG. 2, the fourth switching transistor M4 may be a P-type transistor. Alternatively, the fourth switching transistor may also be an N-type transistor, which will not be limited here.

For example, in the above-described pixel compensation circuit provided by embodiments of the present disclosure, when the fourth switching transistor is in a turning-on state under the control of the light-emission control signal terminal, the fourth switching transistor may provide the signal of the first power supply terminal to the first electrode of the driving transistor, so as to initialize the first electrode of the driving transistor and charge the storage capacitor and the voltage division capacitor.

For example, in the above-described pixel compensation circuit provided by embodiments of the present disclosure, as shown in FIG. 2, the threshold compensation sub-circuit 3 may include: a first switching transistor M1 and a second switching transistor M2.

A control electrode of the first switching transistor M1 is connected with the compensation control signal terminal CS, a first electrode of the first switching transistor M1 is connected with the reference voltage signal terminal Vref, and a second electrode of the first switching transistor M1 is connected with the control electrode G of the driving transistor M0.

A control electrode of the second switching transistor M2 is connected with the compensation control signal terminal CS, a first electrode of the second switching transistor M2 is connected with the reference voltage signal terminal Vref, and a second electrode of the second switching transistor M2 is connected with the second electrode D of the driving transistor M0.

For example, in the above-described pixel compensation circuit provided by embodiments of the present disclosure, as shown in FIG. 2, the first switching transistor M1 and the second switching transistor M2 may be P-type transistors. Alternatively, the first switching transistor and the second switching transistor may also be N-type transistors, which will not be limited here.

For example, in the above-described pixel compensation circuit provided by embodiments of the present disclosure, when the first switching transistor is in a turning-on state under the control of the compensation control signal terminal, the first switching transistor may provide the signal of the reference voltage signal terminal to the control electrode of the driving transistor, so as to control the turning-on of the driving transistor. When the second switching transistor is in a turning-on state under the control of the compensation control signal terminal, the second switching transistor may connect the second electrode of the driving transistor to the reference voltage signal terminal, so that the voltage stored in the first electrode of the driving transistor is discharged via the turned-on driving transistor and the turned-on second switching transistor, so as to write the threshold voltage of the driving transistor into the first electrode of the driving transistor.

The foregoing is merely exemplary illustration of specific structures of respective sub-circuits in the pixel compensation circuit provided by embodiments of the present disclosure. For example, the specific structures of the respective sub-circuits are not limited to the above-described structures provided by embodiments of the present disclosure, and may also be other structures known by those skilled in the art, which will not be limited here.

Further, in order to simplify a fabrication process flow of the pixel compensation circuit, in the above-described pixel compensation circuit provided by embodiments of the present disclosure, as shown in FIG. 2, when the driving transistor M0 is a P-type transistor, all transistors may be P-type transistors.

For example, in the above-described pixel compensation circuit provided by embodiments of the present disclosure, a P-type transistor is turned off under an action of a high potential on the gate electrode, and is turned on under an action of a low potential on the gate electrode; and an N-type transistor is turned on under an action of a high potential on the gate electrode, and is turned off under an action of a low potential on the gate electrode.

It should be noted that, in the above-described pixel compensation circuit provided by embodiments of the present disclosure, the driving transistor and the switching transistor may be thin film transistors (TFTs), and may also be metal oxide semiconductor (MOS) field effect transistors, which will not be limited here. For example, the control electrodes of the above-described switching transistors are gate electrodes, and according to different types of the switching transistors and different signals of the signal terminals, the first electrodes of the switching transistors may be used as source electrodes, and the second electrodes may be used as drain electrodes: or the first electrodes of the switching transistors may be used as drain electrodes, and the second electrodes may be used as source electrodes, which will not be specifically distinguished here.

Figure 3:
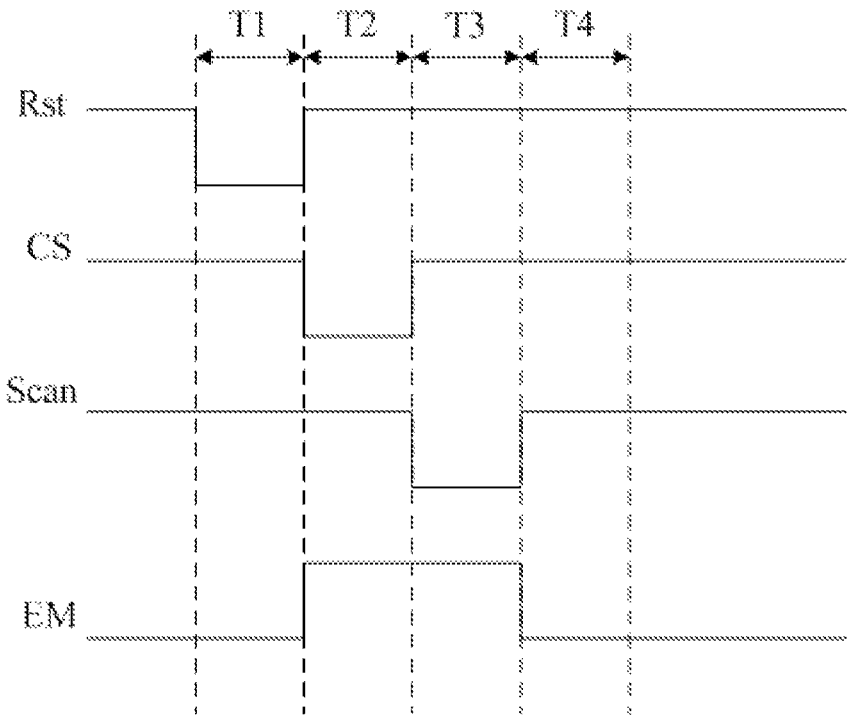
FIG. 3 is a timing diagram of a pixel compensation circuit provided by a embodiment of the present disclosure.

Hereinafter, a working process of the above-described pixel compensation circuit provided by embodiments of the present disclosure will be described by taking the pixel compensation circuit shown in FIG. 2 as an example, in conjunction with a circuit timing diagram. In the description below, 1 represents a high potential and 0 represents a low potential. It should be noted that, 1 and 0 are logic potentials, which are merely intended to better explain the specific working process according to embodiments of the present disclosure, rather than representing voltages applied to the control electrodes of the respective switching transistors during specific implementation. In FIG. 2, the driving transistor M0 is a P-type transistor, and all the switching transistors are P-type transistors; and a corresponding input timing diagram is shown in FIG. 3. Specifically, four phases, i.e., an initialization phase T1, a threshold compensation phase T2, a data writing phase T3 and a light emission phase T4 in the input timing diagram shown in FIG. 3 are selected.

In the initialization phase T1, Rst=0, CS=1, Scan=1, and EM=0.

Since Rst=0, the third switching transistor M3 is turned on and provides the signal of the first power supply terminal VDD to the control electrode G of the driving transistor M0, so as to initialize the control electrode G of the driving transistor M0. Since EM=0, the fourth switching transistor M4 is turned on, provides the signal of the first power supply terminal VDD to the first electrode S of the driving transistor M0, so that the voltage of the first electrode S of the driving transistor M0 is the voltage Vdd of the first power supply terminal VDD, the first electrode S of the driving transistor M0 is initialized, and the voltage division capacitor C2 is charged. Thus, the storage capacitor C1 and the voltage division capacitor C2 maintain stability of the voltage Vdd of the first electrode S of the driving transistor M0. Since CS=1, both the first switching transistor M1 and the second switching transistor M2 are turned off. Since Scan=1, the fifth switching transistor M5 is turned off.

In the threshold compensation phase T2, Rst=1, CS=0, Scan=1, and EM=1.

Since CS=0, both the first switching transistor M1 and the second switching transistor M2 are turned on. The turned-on first switching transistor M1 provides the signal of the reference signal terminal Vref to the control electrode G of the driving transistor M0, so as to turn on the driving transistor M0. The voltage Vdd of the first electrode S of the driving transistor M0 is discharged via the turned-on driving transistor M0 and the turned-on second switching transistor M2, until the voltage of the first electrode S of the driving transistor M0 becomes: $V_{ref}+|V_{th}|$, where Vref is the voltage of the signal of the reference voltage signal terminal Vref. The storage capacitor C1 and the voltage division capacitor C2 may respectively store the voltage $V_{ref}+|V_{th}|$. Since Rst=1, the third switching transistor M3 is turned off. Since EM=1, the fourth switching transistor M4 is turned off. Since Scan=1, the fifth switching transistor M5 is turned off.

In the data writing phase T3, Rst=1, CS=1, Scan=0, and EM=1.

Since Scan=0, the fifth switching transistor M5 is turned on and provides the data signal of the data signal terminal Data to the control electrode G of the driving transistor M0, so that the voltage of the control electrode G of the driving transistor M0 becomes the voltage Vdata of the data signal. Since the first electrode S of the driving transistor M0 is in a floating state (for example, when EM=1, the transistor M4 is turned off, so as to interrupt a path between the VDD and the first electrode S), due to a coupling effect of the storage capacitor C1, the Vdata may be coupled to the first electrode S of the driving transistor M0, and due to a voltage dividing effect of the voltage division capacitor C1, the voltage of the first electrode S of the driving transistor M0 becomes:

$$V_{ref}+|V_{th}|+(V_{data}-V_{ref})\frac{c_1}{c_1+c_2}.$$

Since Rst=1, the third switching transistor M3 is turned off. Since EM=1, the fourth switching transistor M4 is turned off. Since CS=1, both the first switching transistor M1 and the second switching transistor M2 are turned off.

In the light emission phase T4, Rst=1, CS=1, Scan=1, and EM=0.

Since EM=0, the fourth switching transistor M4 is turned on and provides the signal of the first power supply terminal VDD to the first electrode S of the driving transistor M0, so that the voltage of the first electrode S of the driving transistor M0 is the voltage Vdd of the first power supply terminal VDD. The switching transistors M1, M2, M3 and M5 are all turned off. At this point, the control electrode G of the driving transistor M0 is in a floating state, that is, the switching transistors M1, M3, and M5 connected with the control electrode G are all turned off. Due to the bootstrap effect, the storage capacitor C1 may maintain stability of the voltage difference between the first electrode S and the control electrode G of the driving transistor M0, so that the voltage of the control electrode G of the driving transistor M0 jumps to:

$$V_{data}+V_{dd}-\left[V_{ref}+|V_{th}|+(V_{data}-V_{ref})\frac{c_1}{c_1+c_2}\right].$$

According to characteristic of a current in a saturated state, it can be known that a driving current IL generated by the driving transistor M0 for driving the light-emitting device L to emit light satisfies a formula:

$$I_L=K(V_{sg}-|V_{th}|)^2=K\left[V_{ref}+|V_{th}|+(V_{data}-V_{ref})\frac{c_1}{c_1+c_2}-V_{data}-|V_{th}|^2\right],$$

that is, $$I_L = K\left[V_{ref} + (V_{data} - V_{ref})\frac{c_1}{c_1 + c_2} - V_{data}\right]^2,$$

where: Vsg is a source-gate voltage of the driving transistor M0; K is a structural parameter, and a numerical value of K in a same structure is relatively stable, so that K may be considered as a constant. It can be seen from the above formula that when the driving transistor M0 is in the saturated state, the current is only related to the voltage Vref of the reference signal terminal Vref and the voltage Vdata of the data signal terminal Data. The current is not related to the threshold voltage Vth of the driving transistor M0 and the voltage Vdd of the first power supply terminal VDD, which may eliminate influence of the threshold voltage Vth drift of the driving transistor M0 and IR drop on the driving current, so as to maintain stability of the driving current of the light-emitting device L, and further ensure normal operation of the light-emitting device L.

In the above-described embodiments provided by the present disclosure, in the initialization phase, the control electrode and the first electrode of the driving transistor are respectively reset with the voltage of the first power supply terminal, so as to turn off the driving transistor. In the threshold compensation phase, the reference voltage signal of the reference voltage signal terminal is input to the control electrode of the driving transistor via an independent first switching transistor, so as to turn on the driving transistor, and compensate the Vth using a source following approach by the turned-on driving transistor and the turned-on second switching transistor. In the data writing phase, the data signal is input via another independent fifth switching transistor. Therefore, it is possible to avoid a problem of increase of power consumption of the source driving circuit caused by inputting the data signal and the reference voltage signal with only one switching transistor. When the pixel compensation circuit provided by embodiments of the present disclosure is applied to the display device, the power consumption of the display device can be reduced.

Figure 4:
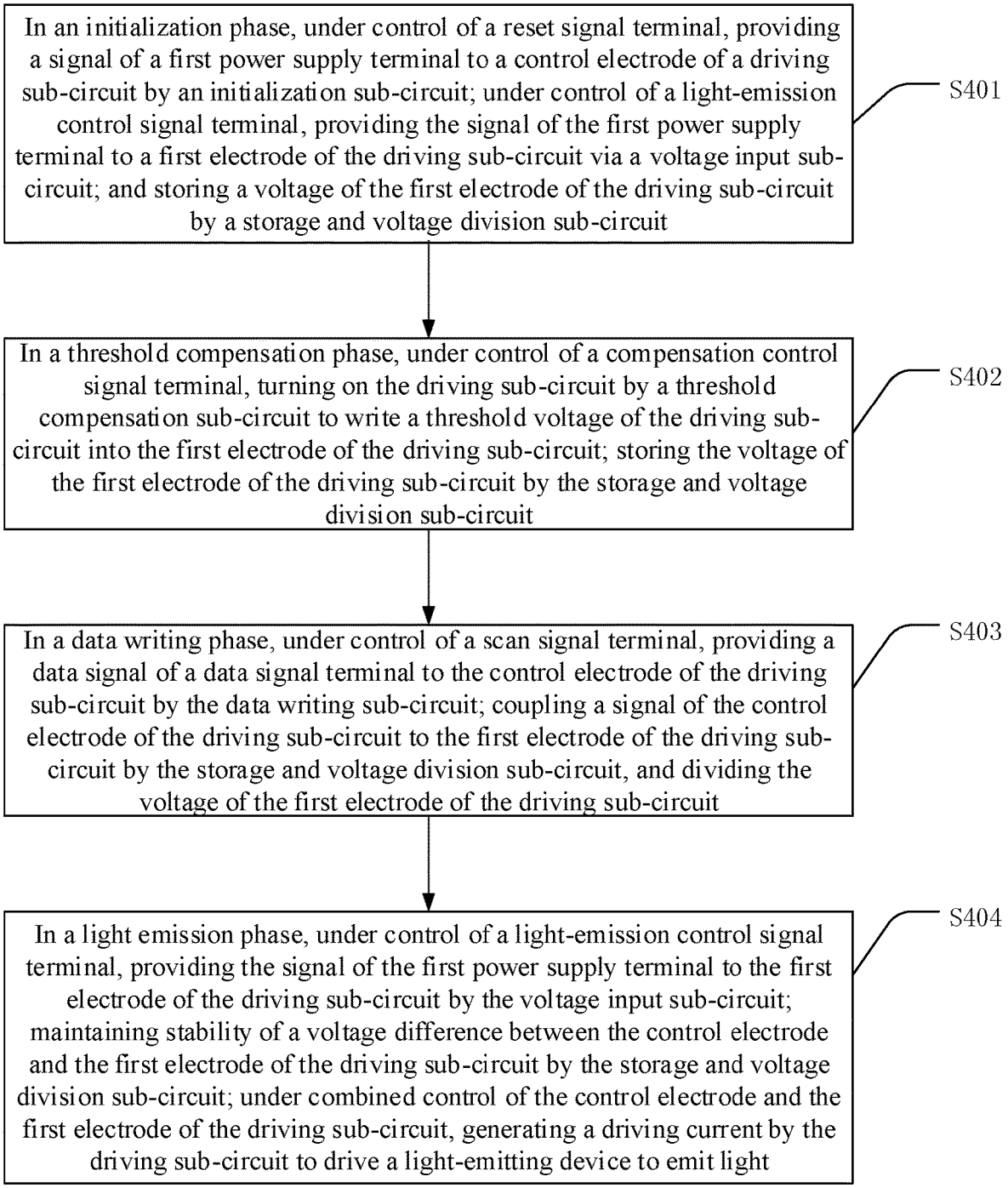
FIG. 4 is a flow chart of a driving method of a pixel compensation circuit provided by an embodiment of the present disclosure.

An embodiment of the present disclosure further provides a driving method of any one of the above-described pixel compensation circuits provided by embodiments of the present disclosure; as shown in FIG. 4, the method comprises:

S401: in an initialization phase, under control of a reset signal terminal, providing a signal of a first power supply terminal to a control electrode of a driving sub-circuit by an initialization sub-circuit; under control of a light-emission control signal terminal, providing the signal of the first power supply terminal to a first electrode of the driving sub-circuit via a voltage input sub-circuit; and storing a voltage of the first electrode of the driving sub-circuit by a storage and voltage division sub-circuit;

S402: in a threshold compensation phase, under control of a compensation control signal terminal, turning on the driving sub-circuit by a threshold compensation sub-circuit to write a threshold voltage of the driving sub-circuit into the first electrode of the driving sub-circuit; storing the voltage of the first electrode of the driving sub-circuit by the storage and voltage division sub-circuit;

S403: in a data writing phase, under control of a scan signal terminal, providing a data signal of a data signal terminal to the control electrode of the driving sub-circuit by the data writing sub-circuit; coupling a signal of the control electrode of the driving sub-circuit to the first electrode of the driving sub-circuit by the storage and voltage division sub-circuit, and dividing the voltage of the first electrode of the driving sub-circuit;

S404: in a light emission phase, under control of a light-emission control signal terminal, providing the signal of the first power supply terminal to the first electrode of the driving sub-circuit by the voltage input sub-circuit; maintaining stability of a voltage difference between the control electrode and the first electrode of the driving sub-circuit by the storage and voltage division sub-circuit; under combined control of the control electrode and the first electrode of the driving sub-circuit, generating a driving current by the driving sub-circuit to drive a light-emitting device to emit light.

The above-described driving method provided by embodiments of the present disclosure may make the driving current generated by the driving sub-circuit (for example, the driving transistor) be irrelevant to the threshold voltage of the driving transistor and the voltage of the first power supply terminal, may avoid the influence of the threshold voltage of the driving transistor and IR drop on the driving current flowing through the light-emitting device, so as to maintain stability of the driving current, and to further improve uniformity of image brightness of the display region in the display device.

An embodiment of the present disclosure further provides a display device, comprising any one of the above-described pixel compensation circuits provided by embodiments of the present disclosure. The display device may be a mobile phone, a tablet personal computer, a television, a monitor, a laptop, a digital photo frame, a navigator, and any other product or component having a display function. With respect to other conventional components of the display device, they will not be repeated here, which should not be taken as limitation to the present disclosure. For implementation of the display device, the embodiments of the above-described pixel compensation circuit may be referred to, and repeated description will no longer be provided.

The embodiments of the present disclosure provide the pixel compensation circuit and the driving method thereof, and the display device. The pixel compensation circuit comprises: the initialization sub-circuit, the data writing sub-circuit, the threshold compensation sub-circuit, the voltage input sub-circuit, the storage and voltage division sub-circuit, the driving sub-circuit and the light-emitting device. The initialization sub-circuit is configured to provide the signal of the first power supply terminal to the control electrode of the driving sub-circuit under the control of the reset signal terminal. The data writing sub-circuit is configured to provide the signal of the data signal terminal to the control electrode of the driving sub-circuit under the control of the scan signal terminal. The voltage input sub-circuit is configured to provide the signal of the first power supply terminal to the first electrode of the driving sub-circuit under the control of the light-emission control signal terminal. The storage and voltage division sub-circuit is configured to: store the voltage of the first electrode of the driving sub-circuit; when the first electrode of the driving sub-circuit is floating, couple the voltage of the control electrode of the driving sub-circuit to the first electrode of the driving sub-circuit and divide the voltage of the first electrode of the driving sub-circuit; and when the control electrode of the driving sub-circuit is floating, maintain stability of the voltage difference between the control electrode and the first electrode of the driving sub-circuit. The threshold compensation sub-circuit is configured to turn on the driving sub-circuit under the control of the compensation control signal terminal, to write the threshold voltage of the driving sub-circuit into the first electrode of the driving sub-circuit. Therefore, by mutual cooperation of the above-described respective sub-circuits, the driving current of the driving sub-circuit for driving the light-emitting device to emit light can be made to be irrelevant to the threshold voltage of the driving sub-circuit and the voltage at the first power supply terminal, to avoid influence of the threshold voltage of the driving sub-circuit and IR drop on the driving current flowing through the light-emitting device, so as to maintain stability of the driving current, and to further improve uniformity of image brightness of the display region in the display device. In addition, since the data signal terminal is used merely for inputting the data signal, when the above-described pixel compensation circuit is applied to the display device, the source driving circuit may output only the data signal through the data line, which may reduce power consumption as compared with a source driving circuit that outputs different signals. Thus, power consumption of the OLED display device is further reduced.

In the disclosure, terms such as "first", "second" and the like used in the present disclosure do not indicate any sequence, quantity or significance but only for distinguishing different constituent parts. Also, the terms such as "a," "an," or "the" etc., are not intended to limit the amount, but indicate the existence of at least one. The terms "comprises," "comprising," "includes," "including," etc., are intended to specify that the elements or the objects stated before these terms and encompass the elements or the objects and equivalents thereof listed after these terms, but do not preclude the other elements or objects.

It is evident that one person skilled in the art can make various changes or modifications to the present disclosure without departure from the spirit and scope of the present disclosure. Thus, if these changes and modifications to the present disclosure are within the scope of the claims of the present disclosure and equivalent technologies, the present disclosure also intends to include all such changes and modifications within its scope.

What are described above is related to the illustrative embodiments of the disclosure only and not limitative to the scope of the disclosure; any changes or replacements easily for those technical personnel who are familiar with this technology in the field to envisage in the scopes of the disclosure, should be in the scope of protection of the present disclosure. Therefore, the scopes of the disclosure are defined by the accompanying claims.

The invention claimed is:

1. A pixel compensation circuit, comprising: an initialization sub-circuit, a data writing sub-circuit, a threshold compensation sub-circuit, a voltage input sub-circuit, a storage and voltage division sub-circuit, a driving sub-circuit and a light-emitting device; wherein:

the initialization sub-circuit is respectively connected with a reset signal terminal, a first power supply terminal and a control electrode of the driving sub-circuit, and is configured to provide a signal of the first power supply terminal to the control electrode of the driving sub-circuit under control of the reset signal terminal;

the data writing sub-circuit is respectively connected with a scan signal terminal, a data signal terminal and the control electrode of the driving sub-circuit, and is configured to provide a data signal of the data signal terminal to the control electrode of the driving sub-circuit under control of the scan signal terminal;

the voltage input sub-circuit is respectively connected with a light-emission control signal terminal, the first power supply terminal and a first electrode of the driving sub-circuit, and is configured to provide the signal of the first power supply terminal to the first electrode of the driving sub-circuit under control of the light-emission control signal terminal;

the storage and voltage division sub-circuit is respectively connected with the control electrode of the driving sub-circuit, the first electrode of the driving sub-circuit and a reference voltage signal terminal, and is configured to: store a voltage of the first electrode of the driving sub-circuit; when the first electrode of the driving sub-circuit is floating, couple a voltage of the control electrode of the driving sub-circuit to the first electrode of the driving sub-circuit, and divide a voltage of the first electrode of the driving sub-circuit; and when the control electrode of the driving sub-circuit is floating, maintain stability of a voltage difference between the control electrode and the first electrode of the driving sub-circuit;

the threshold compensation sub-circuit is respectively and directly connected with a compensation control signal terminal, the reference voltage signal terminal, the control electrode of the driving sub-circuit, a second electrode of the driving sub-circuit and a first terminal of the light-emitting device, and is configured to turn on the driving sub-circuit to write a threshold voltage of the driving sub-circuit into the first electrode of the driving sub-circuit under control of the compensation control signal terminal; and the first terminal of the light-emitting device is connected with the second electrode of the driving sub-circuit, and a second terminal of the light-emitting device is connected with a second power supply terminal.

2. The pixel compensation circuit according to claim 1, wherein the driving sub-circuit includes a driving transistor.

3. The pixel compensation circuit according to claim 2, wherein the threshold compensation sub-circuit includes: a first switching transistor and a second switching transistor;

a control electrode of the first switching transistor is connected with the compensation control signal terminal, a first electrode of the first switching transistor is connected with the reference voltage signal terminal, and a second electrode of the first switching transistor is connected with a control electrode of the driving transistor; and a control electrode of the second switching transistor is connected with the compensation control signal terminal, a first electrode of the second switching transistor is connected with the reference voltage signal terminal, and a second electrode of the second switching transistor is connected with a second electrode of the driving transistor.

4. The pixel compensation circuit according to claim 2, wherein the initialization sub-circuit includes: a third switching transistor; and a control electrode of the third switching transistor is connected with the reset signal terminal, a first electrode of the third switching transistor is connected with the first power supply terminal, and a second electrode of the third switching transistor is connected with a control electrode of the driving transistor.

5. The pixel compensation circuit according to claim 2, wherein the storage and voltage division sub-circuit includes: a storage capacitor and a voltage division capacitor;

a first terminal of the storage capacitor is connected with a control electrode of the driving transistor, and a second terminal of the storage capacitor is connected with a first electrode of the driving transistor; and a first terminal of the voltage division capacitor is connected with the first electrode of the driving transistor, and a second terminal of the voltage division capacitor is connected with the reference voltage signal terminal.

6. The pixel compensation circuit according to claim 5, wherein a capacitance value of the storage capacitor is smaller than a capacitance value of the voltage division capacitor.

7. The pixel compensation circuit according to claim 6, wherein the capacitance value of the storage capacitor is c1, the capacitance value of the voltage division capacitor is c2, and $$0.75 \leqslant \frac{c_1}{c_2} < 1.$$

8. The pixel compensation circuit according to claim 2, wherein the voltage input sub-circuit includes: a fourth switching transistor; and a control electrode of the fourth switching transistor is connected with the light-emission control signal terminal, a first electrode of the fourth switching transistor is connected with the first power supply terminal, and a second electrode of the fourth switching transistor is connected with a first electrode of the driving transistor.

9. The pixel compensation circuit according to claim 2, wherein the data writing sub-circuit includes: a fifth switching transistor; and a control electrode of the fifth switching transistor is connected with the scan signal terminal, a first electrode of the fifth switching transistor is connected with the data signal terminal, and a second electrode of the fifth switching transistor is connected with a control electrode of the driving transistor.

10. The pixel compensation circuit according to claim 2, wherein the driving transistor is a P-type transistor.

11. The pixel compensation circuit according to claim 3, wherein both the first switching transistor and the second switching transistor are P-type transistors.

12. The pixel compensation circuit according to claim 4, wherein the third switching transistor is a P-type transistor.

13. The pixel compensation circuit according to claim 8, wherein the fourth switching transistor is a P-type transistor.

14. The pixel compensation circuit according to claim 9, wherein the fifth switching transistor is a P-type transistor.

15. The pixel compensation circuit according to claim 1, wherein the light-emitting device is an OLED light-emitting device.

16. A display device, comprising the pixel compensation circuit according to claim 1.

17. A driving method of the pixel compensation circuit according to claim 1, comprising:

in an initialization phase, under control of a reset signal terminal, providing a signal of a first power supply terminal to a control electrode of a driving sub-circuit by an initialization sub-circuit; under control of a light-emission control signal terminal, providing the signal of the first power supply terminal to a first electrode of the driving sub-circuit via a voltage input sub-circuit; and storing a voltage of the first electrode of the driving sub-circuit by a storage and voltage division sub-circuit;

in a threshold compensation phase, under control of a compensation control signal terminal, turning on the driving sub-circuit by a threshold compensation sub-circuit to write a threshold voltage of the driving sub-circuit into the first electrode of the driving sub-circuit; and storing the voltage of the first electrode of the driving sub-circuit by the storage and voltage division sub-circuit;

in a data writing phase, under control of a scan signal terminal, providing a data signal of a data signal terminal to the control electrode of the driving sub-circuit by the data writing sub-circuit; coupling a signal of the control electrode of the driving sub-circuit to the first electrode of the driving sub-circuit by the storage and voltage division sub-circuit, and dividing the voltage of the first electrode of the driving sub-circuit; and in a light emission phase, under control of a light-emission control signal terminal, providing the signal of the first power supply terminal to the first electrode of the driving sub-circuit by the voltage input sub-circuit; maintaining stability of a voltage difference between the control electrode and the first electrode of the driving sub-circuit by the storage and voltage division sub-circuit; and under combined control of the control electrode and the first electrode of the driving sub-circuit, generating a driving current by the driving sub-circuit to drive a light-emitting device to emit light.

18. The driving method according to claim 17, wherein the driving sub-circuit includes a driving transistor.

19. The driving method according to claim 17, wherein the storage and voltage division sub-circuit includes: a storage capacitor and a voltage division capacitor, and a capacitance value of the storage capacitor is smaller than a capacitance value of the voltage division capacitor.

20. The driving method according to claim 19, wherein the capacitance value of the storage capacitor is c1, the capacitance value of the voltage division capacitor is c2, and $$0.75 \leqslant \frac{c_1}{c_2} < 1.$$

* * * * *